United States Patent [19]

Gustafsson

[11] Patent Number: 4,499,700

[45] Date of Patent: Feb. 19, 1985

[54] ROOFING SHEET

[75] Inventor: Erik Gustafsson, Luleå , Sweden

[73] Assignee: Plannja AB, Luleå , Sweden

[21] Appl. No.: 329,279

[22] PCT Filed: Apr. 27, 1981

[86] PCT No.: PCT/SE81/00128

§ 371 Date: Dec. 7, 1981

§ 102(e) Date: Dec. 7, 1981

[87] PCT Pub. No.: WO81/03196

PCT Pub. Date: Nov. 12, 1981

[30] Foreign Application Priority Data

Apr. 28, 1980 [SE] Sweden ..... 8003210

[51] Int. Cl.[3] ..... E04B 7/02; E04D 1/34

[52] U.S. Cl. ..... 52/478; 52/531; 52/542; 52/552; 52/630

[58] Field of Search ..... 52/478, 531, 552, 551, 52/630, 542, 474

[56] References Cited

U.S. PATENT DOCUMENTS

| | | | |
|---|---|---|---|
| 1,150,425 | 8/1915 | Gore | 52/552 |
| 1,221,370 | 4/1917 | Overbury et al. | 52/630 X |
| 1,648,081 | 11/1927 | Tyra | 52/521 |
| 2,626,577 | 1/1953 | Roush et al. | 52/531 X |
| 2,832,300 | 4/1958 | Jacobson | 52/478 X |
| 3,059,733 | 10/1962 | Hermann | 52/537 |
| 3,114,218 | 12/1963 | Macquere | 52/478 X |
| 3,486,277 | 12/1969 | Bauer | 52/478 X |
| 3,593,479 | 7/1971 | Hinds | 52/531 X |
| 3,886,705 | 6/1975 | Cornland | 52/630 X |
| 4,109,438 | 8/1978 | De La Conche | 52/630 |
| 4,189,889 | 2/1980 | Yanoh | 52/530 |
| 4,301,628 | 11/1981 | Lowe | 52/630 |

FOREIGN PATENT DOCUMENTS

| | | | |
|---|---|---|---|
| 1147824 | 6/1957 | France | 52/542 |
| 2309692 | 11/1976 | France | 52/478 |
| 336998 | 2/1936 | Italy | 52/474 |
| 506222 | 5/1939 | United Kingdom | 52/630 |

*Primary Examiner*—Alfred C. Perham

*Attorney, Agent, or Firm*—Holman & Stern

[57] ABSTRACT

A roofing sheet intended to constitute external roofing, especially for roof constructions for small houses, comprises an upper edge which the mounted state of the sheet extends horizontally and perpendicular to the pitch, and is shaped to act as a beam, a lower edge which extends in parallel with the upper edge and is formed to overlap the upper beam section of an underlying sheet. The upper beam section and the lower edge are connected by groove-shaped portions, which in the mounted state of the sheet extend in the direction of the pitch.

2 Claims, 15 Drawing Figures

1
2
3
4
5
6

ROOFING SHEET

CROSS REFERENCE TO RELATED APPLICATION

The invention of this application is disclosed in corresponding International Application No. PCT/SE81/00128 filed Apr. 27, 1981, the benefit of which is being claimed.

BACKGROUND OF THE INVENTION

1. Field of the Invention

This invention relates to a roofing sheet, which is intended to constitute the external roofing, especially at roof constructions, for small houses.

2. Description of the Prior Art

When roofing, for example of sheet metal or glass fiber, is being mounted on roofs of small houses, boarding is attached sparsely or densely between the upper frames of the rafters, before the external roofing is applied. This has been necessary in order to provide the underlying support required by the roofing material. Conventional external roofings, namely, have not had such a size as to extend between two upper frames of adjacent rafters. The reason for this is that the roofings do not have sufficient carrying capacity so that they can be placed on the upper frames of the rafters and be cantilevered therebetween.

BRIEF SUMMARY OF THE INVENTION

The object of the present invention is to provide a roofing sheet which is self-supported between the upper frames of the rafters. This object has been achieved by means of a roofing sheet having an integral edge portion which is shaped to form a beam extending between the rafters to eliminate the need for any additional underlying support.

BRIEF DESCRIPTION OF THE DRAWINGS

Embodiments of the invention are described below, with reference to the accompanying drawings wherein.

DETAILED DESCRIPTION

Figures 1, 2:
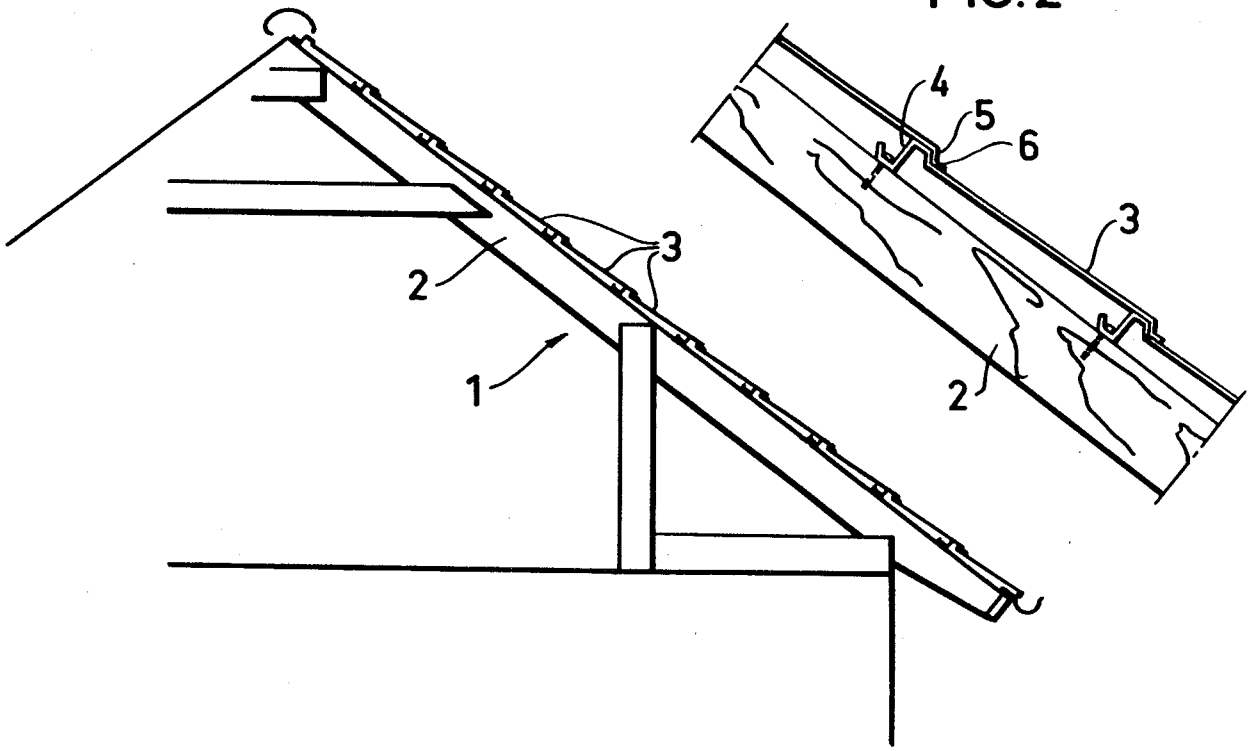
FIG. 1 is a schematic cross-sectional view showing a roof construction with roofing sheets according to the invention.
FIG. 2 is a view similar to FIG. 1 showing a part of the roof construction on an enlarged scale.

In FIG. 1 a roof frame 1 is shown. On its upper rafters 2 roofing sheets 3 are attached which have the form of sheet strips extending across the longitudinal direction of the rafters 2. Said strips normally have a width of about 430 mm and a length, which theoretically can vary from the shortest center to center distance between two adjacent rafters up to 6–8 m, i.e. the maximum that can be handled.

In FIG. 2 the roofing sheets 3 are shown in cross-section on a larger scale. As appears from the Figure, the roofings 3 are formed at their upper edge (when installed) as Z-sections 4, which act as beams between the rafters 2 of adjacent frames 1.

At their lower edge (when installed) the roofing sheets 3 have a downward bent edge 5, which terminates with a forward projecting tongue 6.

Figure 3:
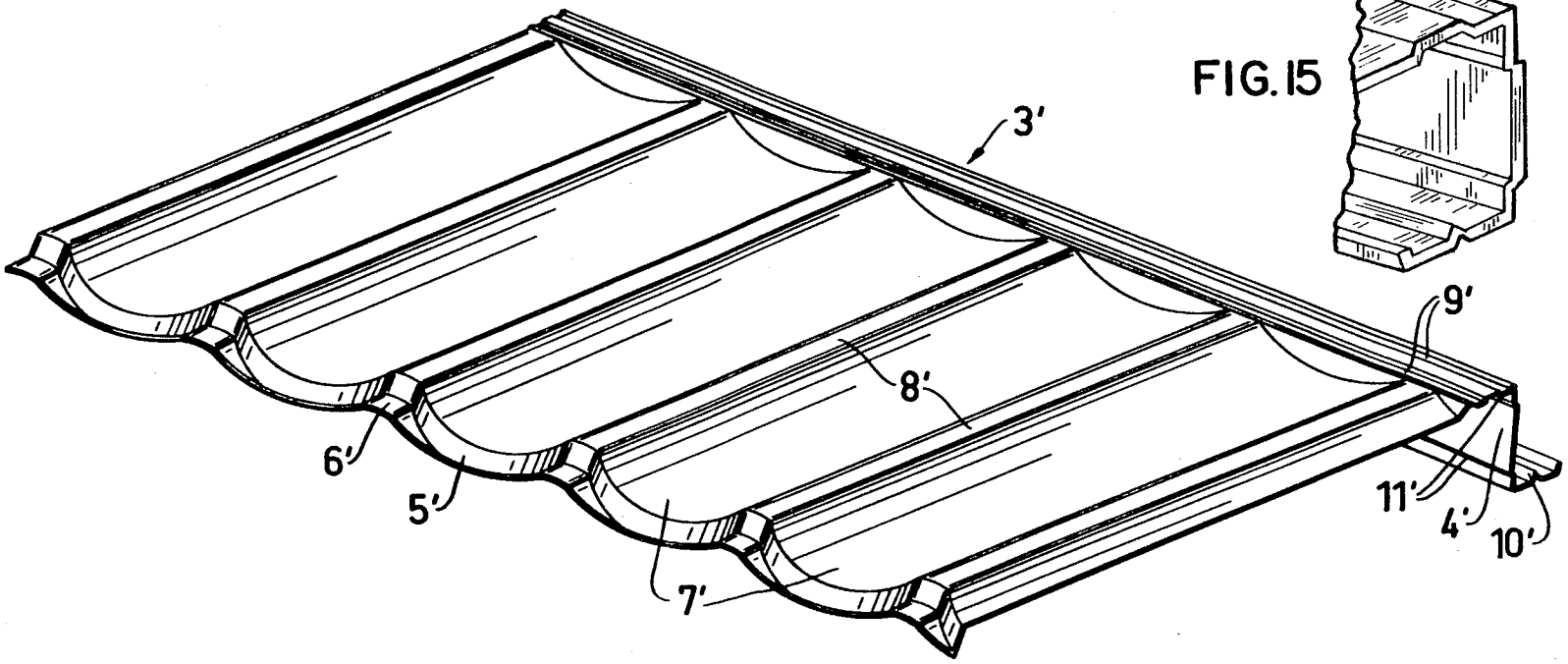
FIG. 3 is a perspective view showing an embodiment of a roofing sheet according to the invention.

The roofing sheet 3' shown in FIG. 3 includes between the Z-beam 4' at its rear edge and the downward bent edge 5' a number of grooves 7', which at their highest located edges are interconnected by ridges 8', the extensions of which form the projecting tongues 6'.

As appears from FIG. 3, the upper flange of the Z-beam 4' is provided with two grooves 9', and the lower flange of the Z-beam 4' is provided with a groove 10'. The web, too, of the Z-beam 4' is provided with reinforcing grooves 11'.

Due to the fact that the downward bent edge 5' of a roofing sheet 3' rests on the Z-beam 4' of a roofing sheet lying below, the grooves 7' and the ridges 8' in principle extend between two Z-beams.

A roof consisting of roofing sheets 3' according to FIG. 3 is capable of being walked on, i.e. the ridges 9' distribute the load to the Z-beams.

The reinforcing grooves 9',10',11' formed in the Z-beam 4' have the object to increase the capacity of the beam 4' to resist buckling.

Owing to the Z-beams 4' extending between the upper frames 2 of the rafters 1, the roofing sheets 3' can be attached directly on the rafters 2 without requiring any ribs, or purlins, between the rafters 2.

Figure 4:
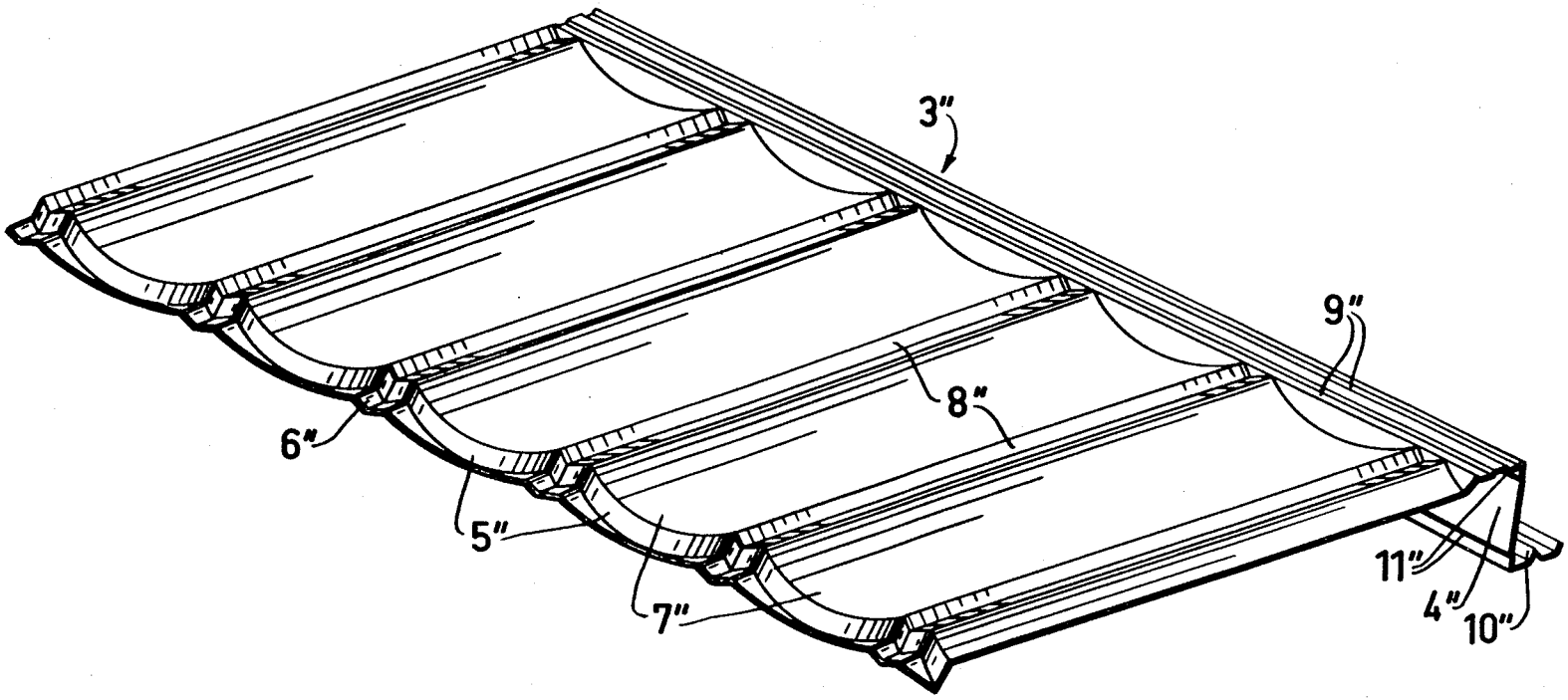
FIG. 4 is a perspective view showing an alternative embodiment of a roofing sheet according to the invention.

The roofing sheet 3" shown in FIG. 4 differs from the one shown in FIG. 3, in that the portions connecting the grooves 7" consist of a downward directed reinforcing fold 8", which forms a narrow groove between the grooves 7".

The slightly lower section height obtained for the portion between the Z-beam 4" and the edge portion 5", compared with FIG. 3, is compensated for by the effect of the reinforcing fold 8" with respect to the carrying capacity of the sheet 3".

When the roofing sheets 3 ,3',3" are being mounted, a joining member, for example a rivet or screw, is attached in the area where the downward bent edge 5,5',5" overlaps the Z-beam 4,4',4".

In the embodiment shown in FIG. 3, the joining member is attached on the projecting tongues 6', for example on every second one. This joining is made pressure tight. As most of the rainfall water flows in the grooves 7', the risk of leakage into the roof at the joining place is not especially great.

As regards the embodiment shown in FIG. 4, the joining member is attached tightly adjacent the projecting tongue 6". Also in this case it is preferable to attach a joining member at every second tongue 6".

In addition to the joining described, the roofing sheets 3,3', 3" are attached to the upper frames 2 of the rafters 1 by means of a suitable attachment member, for example a nail or screw, which extends through the lower flange of the Z-beam 4,4',4''.

Figure 5:
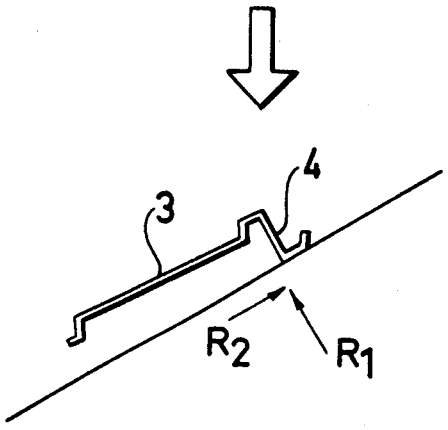
FIGS. 5 and 6 show schematically the reaction forces at snow load on the roofing.

In FIG. 5 are shown reaction forces from the upper frames 2 which act upon a Z-beam 4 of a roofing sheet 3. As appears from FIG. 5, the Z-beam is acted upon by a reaction force $R_1$ perpendicular to the main plane of the sheet 3 and by a reaction force $R_2$ in parallel with the main plane of the sheet 3.

Figure 6:
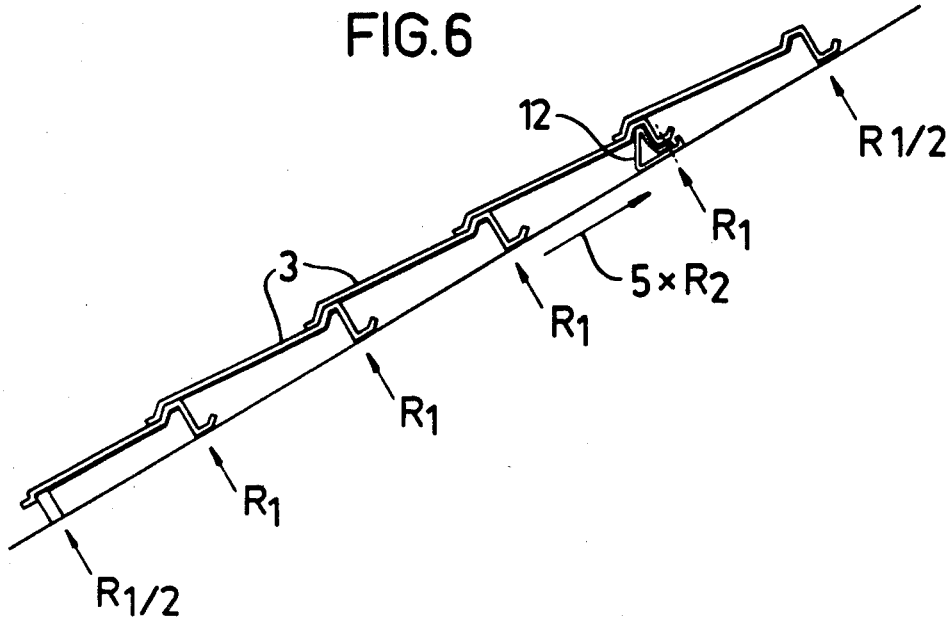

In FIG. 6 the reaction forces $R_1$ and $R_2$ at a number of mounted roofing sheets 3 are shown. For receiving the total of the reaction forces $R_2$, a supporting member 12 is attached below the Z-beam 4 of a roofing sheet 3.

Figure 7:
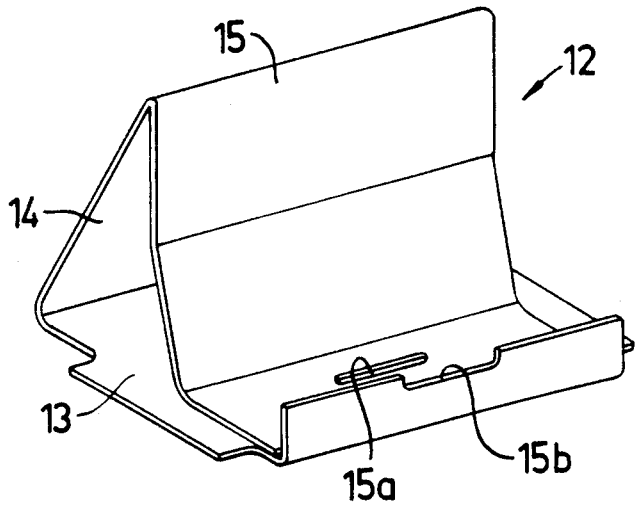
FIG. 7 is a perspective view of a supporting member according to the invention.

In FIG. 7 an embodiment of a supporting member 12 is shown. It includes a bottom portion 13, the free end of which is bent at a right angle. A first supporting portion 14 forms an acute angle with the bottom portion 13. From the upper end of the first supporting portion 14 a second supporting portion 15 extends downward to the bottom portion 13 and abuts with a portion the bottom portion 13. In the bottom portion 13 and in the portion of the second supporting portion 15 abutting the bottom portion a slit-shaped aperture **15*a* is located which extends along the bent-over edge of the bottom portion 13. In said bent-over edge, further, a recess 15*b* is provided directly in front of the aperture 15*a*** in order to facilitate the mounting of the attachment member at the construction site.

As appears from FIG. 6, the attachment of the supporting member 12 and the supported sheet 3 is effected by a common attachment member, which is attached in the aperture **15*a* and extends downward into the upper frame 2 of the rafter 1**.

Figure 8:
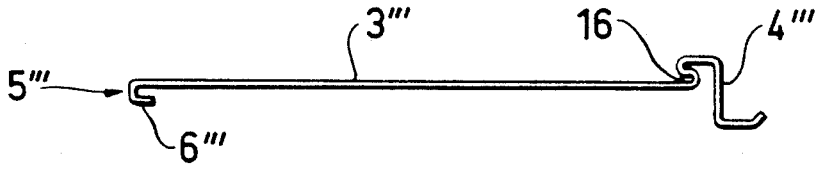
FIG. 8 is a cross-sectional view of a further embodiment of a roofing sheet according to the invention.
Figure 9:
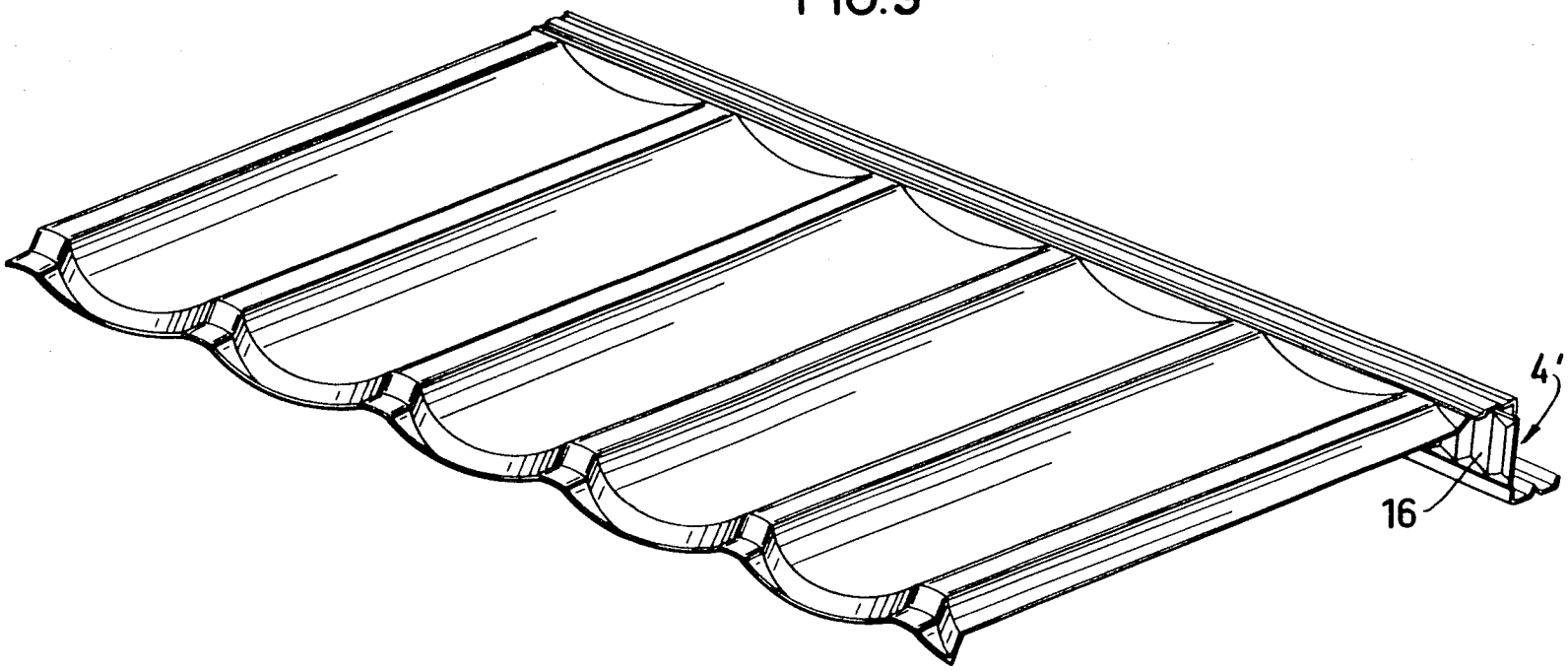
FIGS. 9–12 are perspective views of alternative embodiments of the Z-beam on the edge of the roofing sheet.
Figure 10:
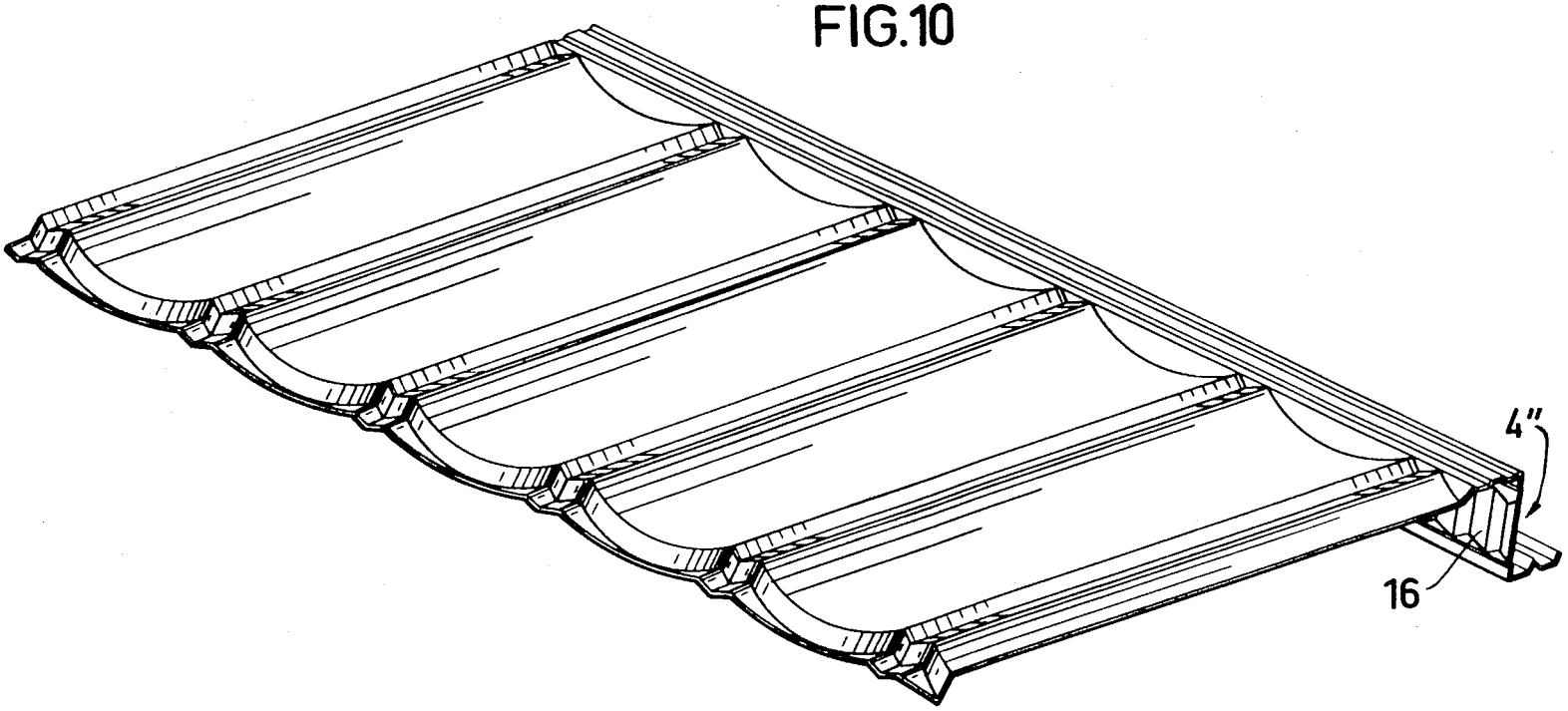
Figure 11:
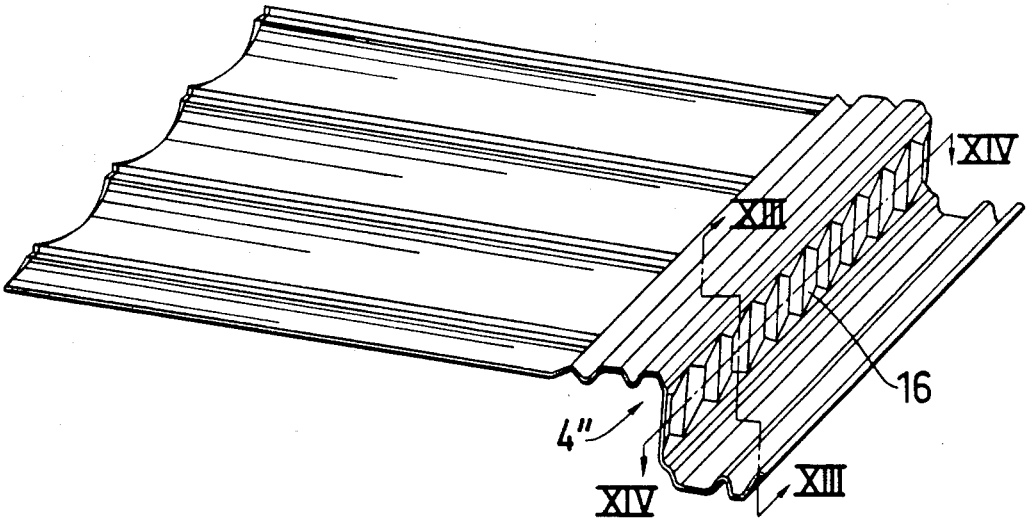
Figure 12:
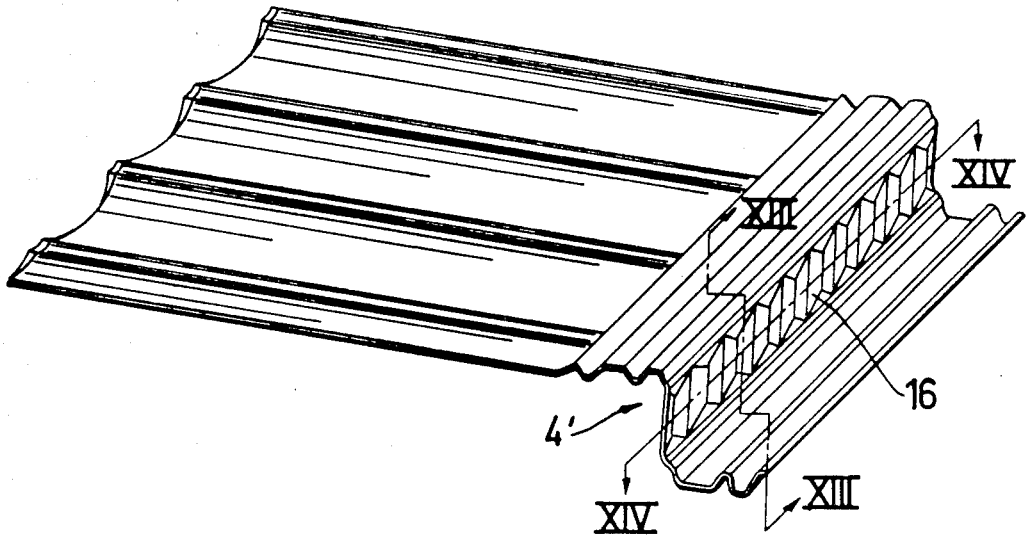
Figure 13:
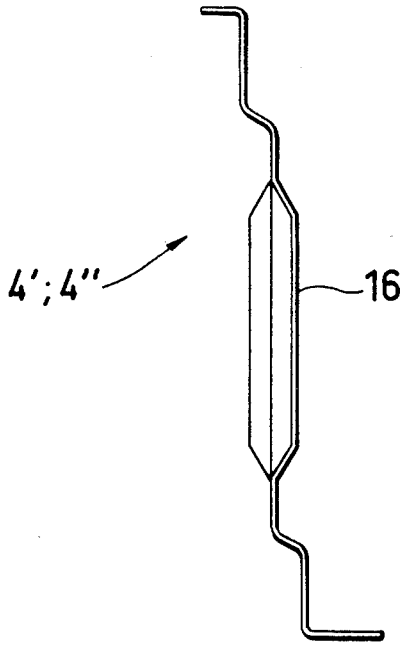
FIGS. 13 and 14 are cross-sectional schematic views of parts of the Z-beam.
Figure 14:
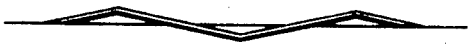

In FIG. 8 a further embodiment of a roofing sheet 3''' according to the invention is shown. It has, like the other embodiments, a Z-beam 4''' at its rear end. At its forward end the sheet 3''' has a downward bent edge portion 5''', which includes a tongue 5''' directed toward the Z-beam 4''' of the sheet 3'''.

In mounted state, the tongue 6''' engages with a groove 16 in connection to the Z-beam 4'''.

The embodiments shown in FIGS. 9–14 have a shaping, fold 16 in the webs of the Z-sections 4',4''. Said shaping has an extension in longitudinal direction perpendicular to the flanges of the Z-beams 4',4''.

The object of said shaping 16 is to prevent buckling of the web of the Z-beams 4',4'' when, for example, snow load is to be transferred from the upper one to the lower flange of the Z-beams 4',4''.

The shaping 16, of course, need not have the form of a fold as shown in FIGS. 9–14, but a great number of variant forms can be imagined. The important matter is that the shaping 16 transfers forces from the upper flange to the lower flange of the Z-beams 4',4''.

Figure 15:
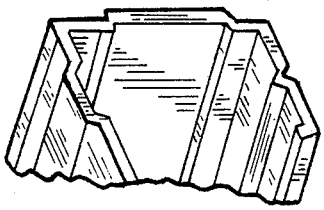
FIG. 15 is a partial perspective view of an alternative embodiment of the invention wherein the beam portion has a C-shaped cross-section.

In the embodiments shown the rear edge of the roofing sheets 3,3',3'', 3''' is formed as a Z-beam 4,4',4'', 4'''. However the rear edge of the roofing sheet may also be formed as a C-beam as shown in FIG. 15. The essential point in this embodiment is that the rear edge has sufficient carrying capacity for bridging the distance between the upper frames 2 of adjacent rafters.

I claim:

1. Roof construction comprising:

a plurality of spaced rafters;

and a plurality of self-supporting roofing sheets each comprising;

an upper edge which extends substantially horizontally parallel to the plane of the pitch of the roof when installed, a lower edge extending substantially parallel to said upper edge, a sheet portion between said upper and lower edges and integral therewith;

said upper edge having a substantially open cross-sectional shape to form a self-supporting beam integral with said sheet portion comprising, a first flange portion fixedly attached to and spanning the spaces between a plurality of said rafters, a second flange portion spaced upwardly from said first flange portion, and a web portion between said flange portions extending at an angle to the plane of the pitch, stiffening grooves in said sheet portion extending between said upper and lower edges, and said lower edge having a shape to overlap said upper edge of an adjacent identical roofing sheet formed by a flange projecting downwardly from said sheet portion and a tongue extending outwardly from the lower edge of said flange substantially parallel to said sheet portion and grooves, so that when said lower edge overlaps said upper edge the lower surface of said tongue substantially conforms with and closely engages the upper surfaces of said sheet portion and grooves adjacent said upper edge;

so that said beams serve as the sole structural supporting members for the roof between said rafters and each roofing sheet is a one piece self-supporting roofing sheet in that said beam is in contact with the rafters and forms a part of the roof structure itself and no additional structural elements are required to support the beam or the sheet portion in a direction substantially perpendicular to the plane of the roof.

2. Roof construction as claimed in claim 1 and further comprising a supporting member to support the sheets against forces parallel to the plane of the roof for at least one of said roofing sheets attached to each rafter, said supporting member comprising an upwardly extending portion which engages said web portion on the side facing in the direction of the lower edge.

* * * * *